US005755257A

United States Patent [19]

Feucht et al.

[11] Patent Number: 5,755,257

[45] Date of Patent: May 26, 1998

[54] RETENTION GATE

[75] Inventors: Werner Feucht, Sachsenheim; Hans-Dieter Loebig, Pfedelbach; Bernd Grieser, Obersulm-Sulzbach, all of Germany

[73] Assignee: BGU Baugesellschaft fur Umweltschutzanlagen mbH, Bretzfeld-Bitzfeld, Germany

[21] Appl. No.: 429,775

[22] Filed: Apr. 27, 1995

[30] Foreign Application Priority Data

May 3, 1994 [EP] European Pat. Off. ..... 94106904

[51] Int. Cl.[6] ..... F16K 31/24; F16K 33/00

[52] U.S. Cl. ..... 137/424; 137/428; 137/445; 137/448

[58] Field of Search ..... 137/425, 428, 137/445, 448, 101.27, 424; 4/507, 508, 510, 512; 251/298

[56] References Cited

U.S. PATENT DOCUMENTS

| | | | |
|---|---|---|---|
| 207,260 | 8/1878 | Downey | 137/424 |
| 2,290,461 | 7/1942 | Young | 137/448 |
| 2,695,072 | 11/1954 | Hauselin | 137/448 |
| 2,699,653 | 1/1955 | Ponsar | 137/424 |
| 2,701,235 | 2/1955 | King | 137/448 |
| 2,739,939 | 3/1956 | Leslie | 137/428 |
| 2,809,752 | 10/1957 | Leslie | 137/428 X |
| 2,882,919 | 4/1959 | Brown | 137/101.27 |
| 2,928,410 | 3/1960 | Vecchio | 137/448 |
| 3,067,879 | 12/1962 | Baker | 137/448 |
| 3,792,499 | 2/1974 | Whitaker | 4/512 |
| 3,815,161 | 6/1974 | Baker | 4/512 |
| 3,916,945 | 11/1975 | Bennett | 137/448 |
| 5,141,644 | 8/1992 | Forde | 137/448 |

FOREIGN PATENT DOCUMENTS 2506126 8/1976 Germany .

*Primary Examiner*—George L. Walton
*Attorney, Agent, or Firm*—Shlesinger Arkwright & Garvey LLP

[57] ABSTRACT

A retention gate (20) is pivotable about a horizontal pivot shaft (22) mounted near the gate's upper edge and is located behind the overflow sill (14) of a storage drainage opening (12), said retention gate in its closed position being in sealing contact by its lower edge (30) with the overflow sill and furthermore being loaded by a counterweight (42) mounted on the outflow side at a distance from the pivot shaft (22), said counterweight generating the closing force required against the inflow side pressure. The retention gate (20) when in its closed position runs from its lower edge in the downstream direction at an average slope of 20°–60 ° relative to the vertical, and the counterweight (42) rigidly affixed to it is guided in such manner that it generates in each gate position a closing torque that approximately matches the torque generated by the amount of drained water required to keep constant the level (24).

13 Claims, 5 Drawing Sheets

RETENTION GATE

The invention concerns a retention gate pivotable about a horizontal pivot shaft mounted near its upper edge while located above a stationary overflow sill, said gate being movable into a closed position by its lower edge being placed against said overflow sill and being loaded by a counterweight mounted, at the outflow side, a distance from its pivot shaft at the outflow side and applying the closing force required against the inflow of the water to be dammed.

The German patent document 25 06 126 discloses rain overflow construction (rain storage means) present in mixed water sewer system to relieve this system, and a subsequent clarification plant in that part of the mixed waters discharges through an overflow opening into a receiving river whereas the clearing plant only receives the amount of mixed waters corresponding to its processing capacity. The overflow openings of such storage means are very high to provide adequate drainage cross-section above the overflow sill for the water flowing from the filled storage means in the event of continued maximum loading of the sewer system. To utilize the height of the storage basin above the overflow sill as additional storage volume, a weir in the form of a movable retention gate is used above the overflow sill in order to reduce the amount of water draining into the receiving river. The mixed waters retained by the weight-loaded gate thereby accumulates in the basin and/or in a canal segment ahead of said basin's overflow sill. The retention gate pivoting about its upper end and the drainage cross-section subtended by it being below the blocking level, it prevents floating contaminants from being drained when being opened. Moreover the retention gate operates in the opposite sense in that it protects the storage basin and the sewer system against flood waters from the receiving river.

Object of the present invention is an improved retention gate offering simple and economical design and able to keep the water level, raised by using this gate, substantially constant and to automatically minimize water level fluctuations occurring, for example, if the raised water level upon or shortly before reaching its predetermined maximum, the regulating retention gate adjusts a compensating drainage opening in relation to an additional, arbitrarily large inflow of mixed waters to the storage basin.

The invention achieves those objects by the features of claim 1. The pivot bearing of the retention gate and the counterweight affixed through a support beam to said shaft allow simple design and effective regulation of drainage. The shape and disposal of the retention gate during opening advantageously entail an approximately horizontal outflow cross-section for the above retaining volume, the high hydrostatic pressure facilitating high drainage rates and high volumes of draining, whereby rapidly responding regulation is assured. Already slight angles of opening of the retention gate provide large outflows and rapidly responding, accurate control of outflow while assuring that changes in the retention level remain slight. The lower the fluctuations in the retention level of the retention gate, the more accurate the prior computation of the additionally useful storage volume of a basin and the higher the setting of the retention threshold in already extant basins, so that, without needing to resort to construction regarding storage means, a gain in storage volume is achieved and waters contamination is reduced.

Because of the length of the support beam and its slope relative to the pivot shaft, the counterweight effect may be optimally matched to the torque balance of the retention gate, whereby the gate's adjusting displacements produce only slight fluctuations in height at the upper zone of the retention level. Fine control is improved further in that the hydraulic forces affect only slightly the gate opening because such an opening is mainly implemented by hydrostatic changes in pressure.

When the retention-gate cross-section between the sealing edge and the pivot shaft comprises a lower segment which is arcuate and convex toward the outflow side, then the retained waters above will provide more rapid drainage in the event of the frequently small opening adjustments, dynamic water forces from large drain flows being effectively transmitted to the pivot shaft in order to assure larger openings of the retention gate.

The pivot shaft of the retention gate may be mounted at about ⅔ the height between the overflow sill and the target retention level. In such a design the gate is subjected to closing forces acting above its pivot shaft and as a result the counterweight may be smaller.

In another embodiment, a counteracting torque matched to the water pressures can be produced at the counterweight support beam for any opening setting of the retention gate by adjusting means effecting a shift in the suspension point of the counterweight during the regulation process. For instance if the counterweight is suspended from a slide block sliding in a possibly arcuate elongated slot in the support beam, then the suspension point will approach the pivot shaft if the support beam slants upward, whereby the torque from the counterweight is automatically reduced if, for a wide-open retention gate with a straight cross-section, the water pressures acting on it are then decreasing.

Further features and advantages of the retention gate of the invention are stated in the description of illustrative embodiments shown in the schematic drawings.

Figure 1:
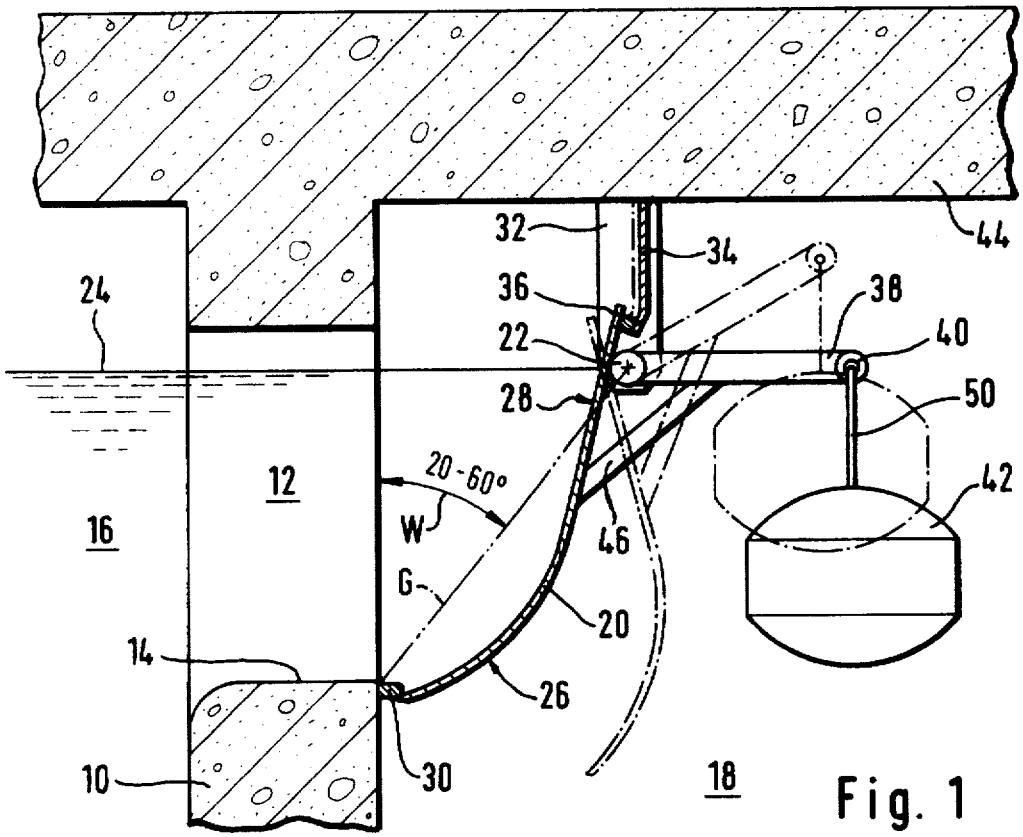
FIG. 1 is a functional diagram and sideview of the retention gate.
Figure 4:
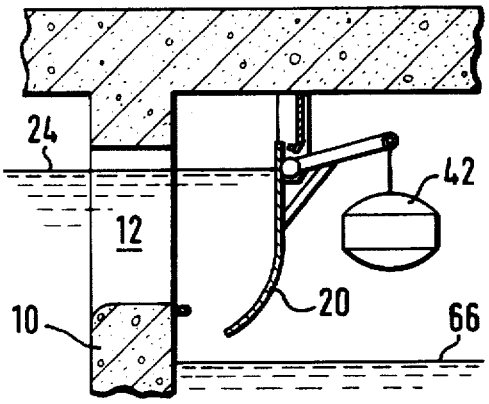
Figure 5:
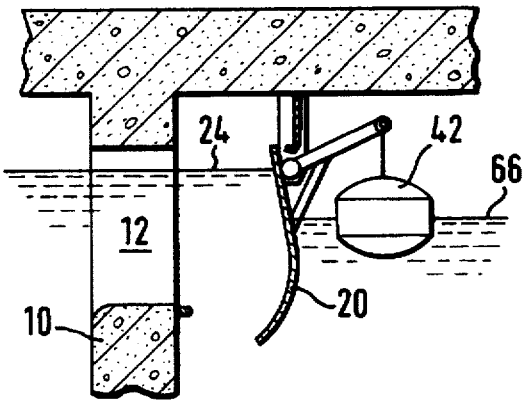
Figure 3:
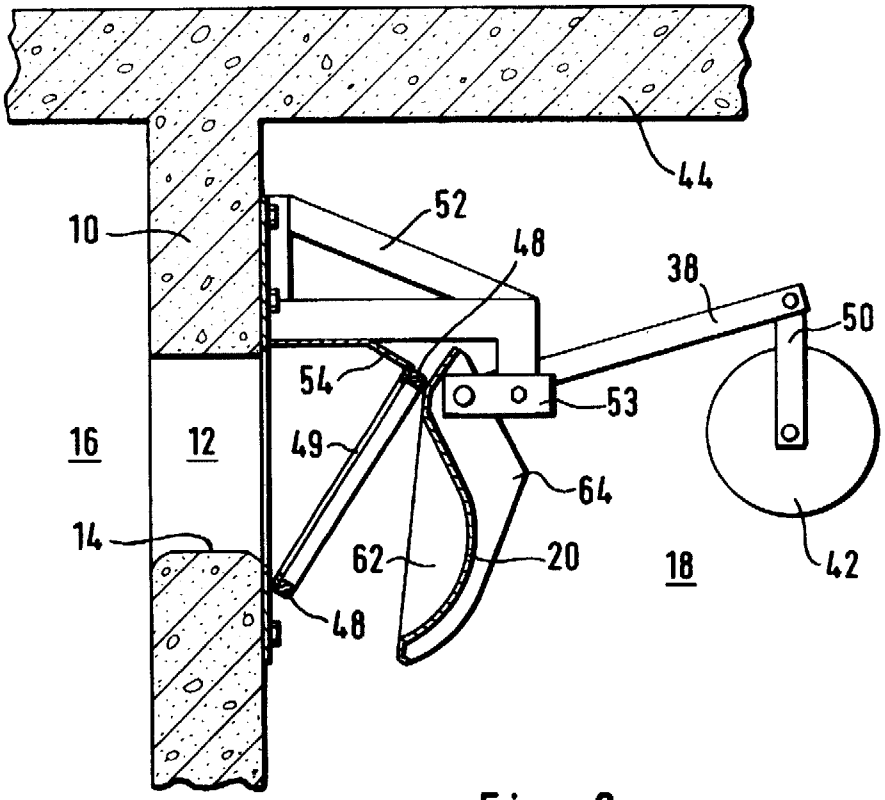
FIG. 3 is the retention gate of FIG. 2 in the open position.
Figure 6:
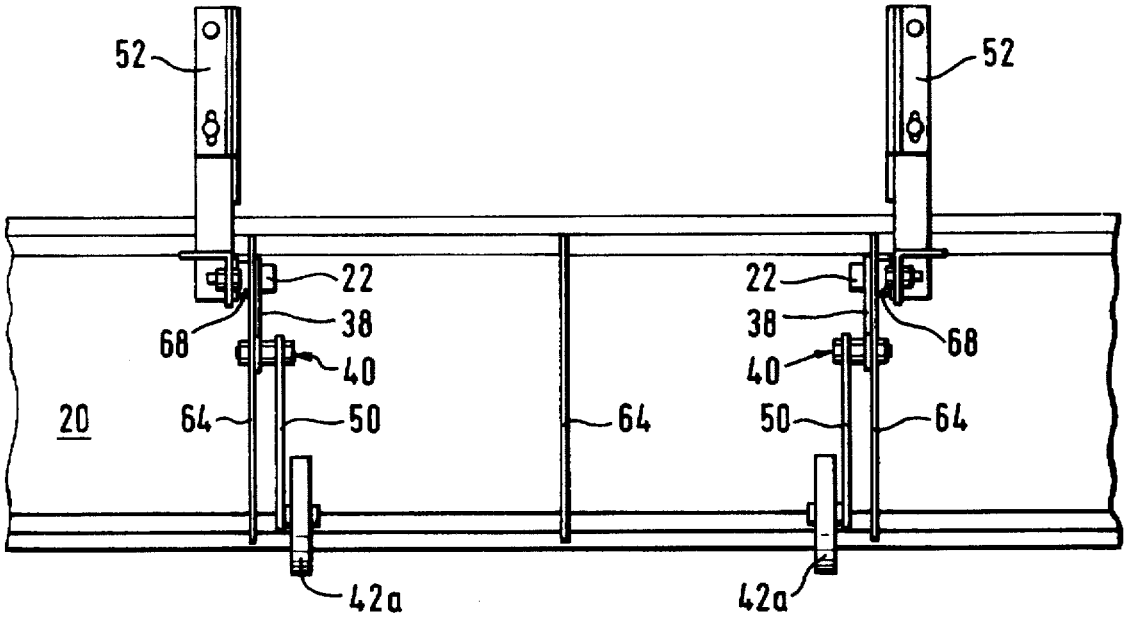
Figure 7:
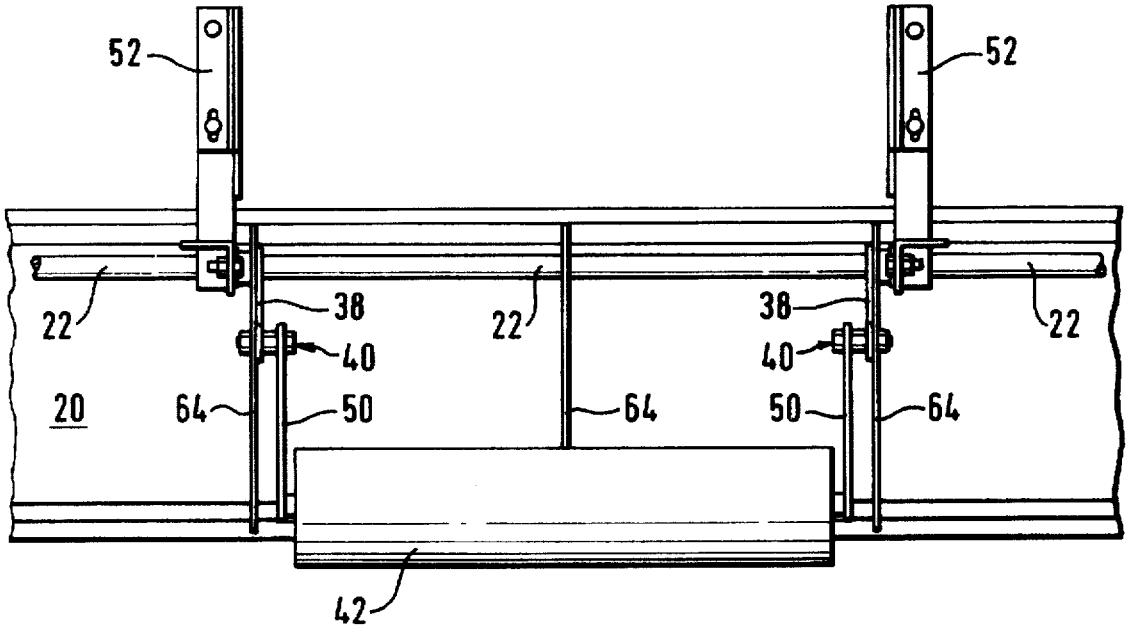
Figure 8:
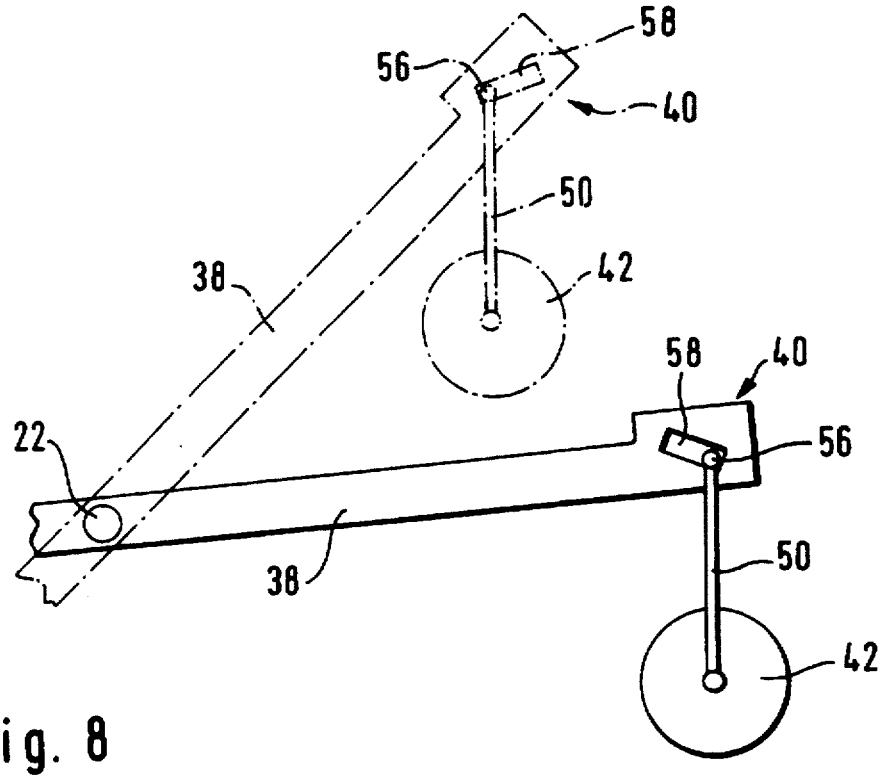
Figure 9:
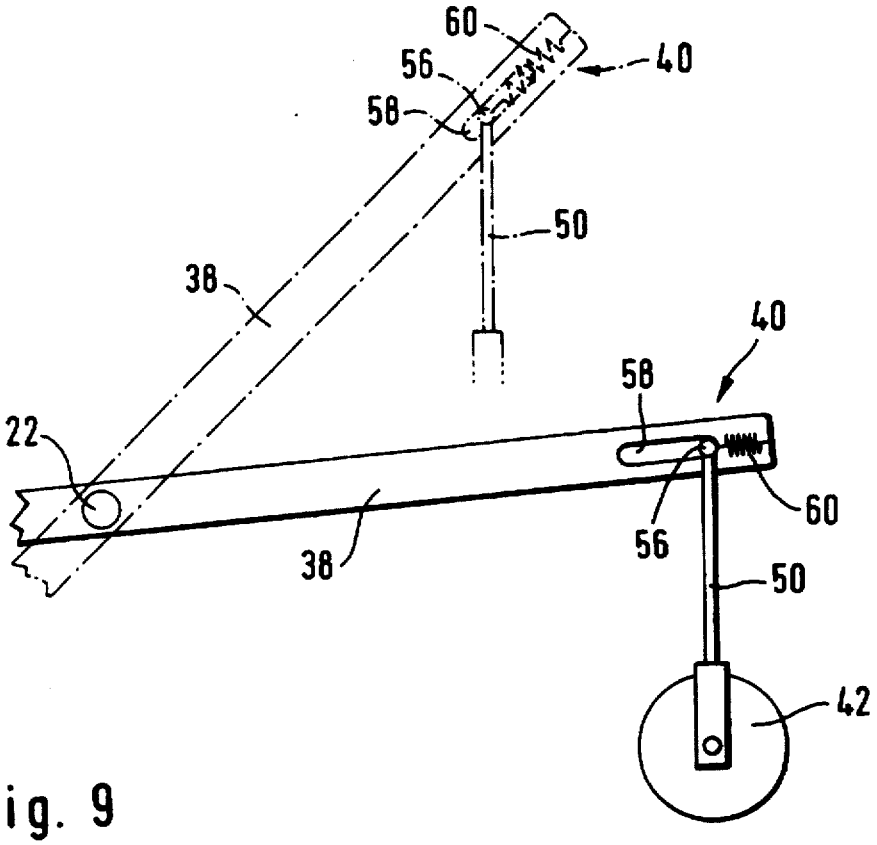
Figure 10:
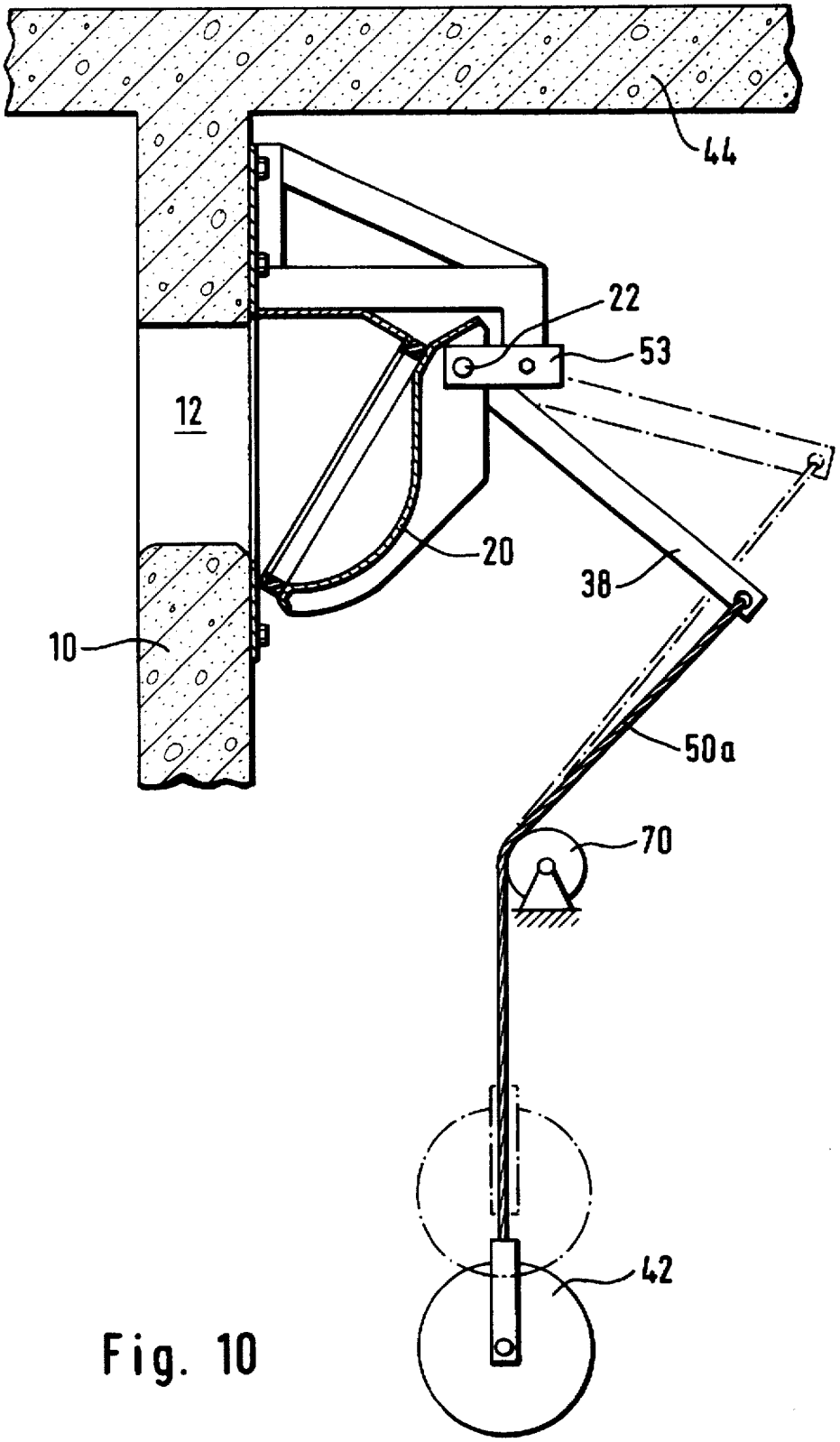

FIG. 4 is the retention gate of FIG. 1 during normal discharge of the standing mixed waters, FIG. 5 is the retention gate in the discharge condition with simultaneous backup at the outfall side, FIG. 6 is a rear view of the retention gate of FIG. 3, FIG. 7 is the retention gate of FIG. 6 but with an altered pivot shaft and counterweight, FIG. 8 are adjusting means to shift the suspension point of the counterweight, FIG. 9 is a variation of the adjustment means of FIG. 8, and FIG. 10 is a system to change the closing force of the counterweight.

FIGS. 1 through 5 show a storage basin 16 with a vertical sidewall 10 and a rectangular drainage opening 12 present therein at a given height above the basin's concrete floor, the lower side of said opening forming an overflow sill 14. The sidewall 10 may the sidewall of the storage basin 16 or of a feed canal issuing tangentially therein. At the lower side of the wall 10 the drainage opening 12 issues into a discharge channel , or into a shaft 18 preceding such a discharge channel, leading to the outfall.

The highest filled level of the storage basin 16 ordinarily determined by the overflow sill 14 is raised by throttling the outflow of the mixed waters, using a retention gate 20, to a desired retention level with maximum water target level 24. The retention gate 20 is mounted in the shaft 18 behind the drainage opening 12 and extends at least over the width, which is perpendicular to the plane of the drawing, of said opening 12. The retention gate 20 is guided in sealed manner on both sides along stationary vertical sealing surfaces or guide walls of the shaft 18 and it is furthermore rigidly affixed near its upper edge to a pivot shaft 22 mounted at the height of the water target level 24 or slightly above or below it.

As shown by FIG. 1, the cross-sectional shape of the retention gate 20 is an arcuate segment 26 which is convex toward the outflow side and which is located between its lower edge resting against a seal 30 and the pivot shaft 22, said segment 26 gradually merging at roughly mid-height of the gate into a generally straight segment 28. It is critical that the retention gate when in closed position shown by the solid lines run downstream generally at a slope from the lower edge to the pivot shaft 22, in the manner of the straight line G, while subtending an acute angle W of about 20° to 60° with a conceptual vertical from the lower rest site.

Even though the retention gate 20 may assume a cross-sectional shape corresponding to the straight line G, a convex cross-section is preferred because in such a case the torque generated in the various gate opening positions will be approximately equal to the restoring moment generated by the counterweight. This torque balance contributes to effectively minimizing the fluctuations in retention level occurring on account of the gate regulation, being for instance 1 to 2 cm.

The upper end of the retention gate 22 as well as one or more support beams 38 of appropriate lengths are mounted to the pivot shaft 22 which in turn is supported in brackets 32 projecting downward from the construction ceiling 44, the free ends of said arms each comprising one fitting 40 (aperture or bolt) from which one or more counterweights 42 are suspended by means of cables or linkrods 50. When the retention gate is closed, the support arms 38 are approximately horizontal or at an angle between −20°, and +20°, preferably between −10° and +15° to the horizontal.

Bracing struts 46 may be used between each support beam 38 and the rear side of the retention gate 20. According to the invention, both the pivot shaft 22 and the support beam(s) 38 affixed to it are mounted downstream of the overflow opening 12, whereby the retention gate 20 automatically carries out a predetermined regulation of outflow.

When the retention gate 20 opens upon the water target level 24 is exceeded, a comparably large cross-sectional opening is achieved already at a slight pivot angle, the retained water flowing vertically down through said opening, and in particular being evacuated rapidly. In the gate's closed position, a free end 36 of the retention gate 20 extending above the pivot shaft 22 rests against a seal of an apron 34 running downward from the construction ceiling 44. This upper seal is a protective means against backflow in the event of outfall backflow, to prevent a return flow of flooding water into the storage basin 16.

When, during normal discharge, as shown in FIG. 4, the outflow level 66 in the discharge channel 18 is below the overflow sill 14, the arcuate segment 26 of the retention gate 20 remains controlled by the torque generated by the water target level 24 above because a comparatively large opening cross-section will be produced upon an already small pivot angle.

As regards the discharge against backpressure in the discharge channel 18 shown in FIG. 5, the counterweight 42 partly dips into the raised outflow level 66. If the counterweight 42 is inherently buoyed, its closing force will be decreased in order that, together with the back pressure on the retention gate 20, a total closing force be exerted to assure thereby regulated outflow from the basin 16. As a result the water target level 24 is kept approximately constant in this case too.

Figure 2:
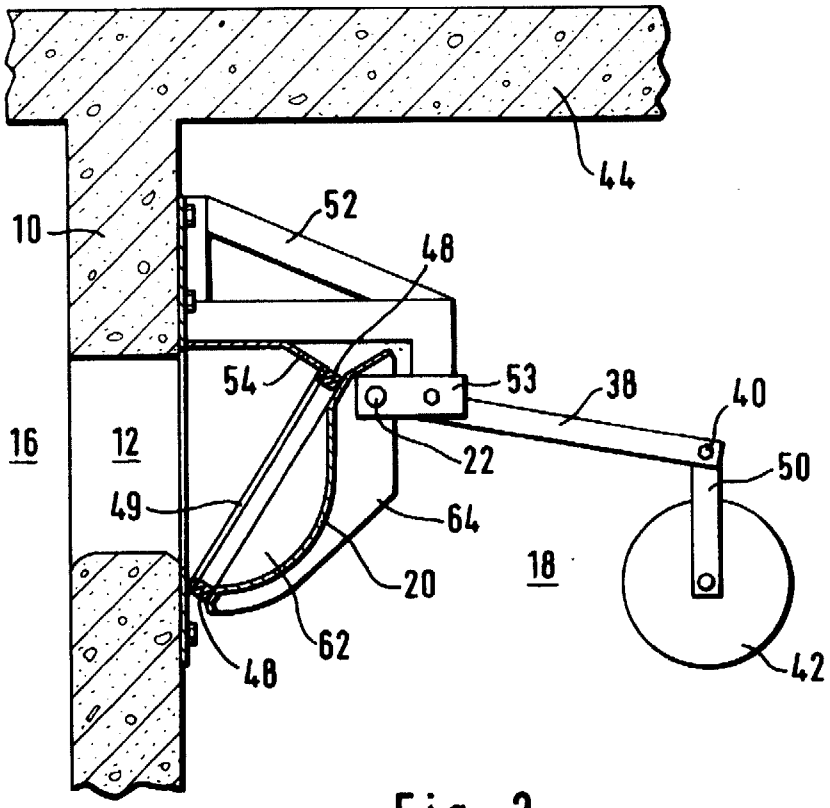
FIG. 2 is a practical embodiment of the retention gate in the closed position

FIGS. 2 and 3 show a practical embodiment of the retention gate 20 in the closed and open positions. Support angles 52 are affixed above the drainage opening 12 to the side wall 10 and receive bolt-adjustable mounts for the pivot shaft 22. The convex, cross-sectional contour of the retention gate 20 is reinforced by two outside lateral flanges 62. The co-planar circumferential edges of the retention gate when in the closed position rest against a peripheral seal 48. The seal 48 is braced by a frame 49 laterally affixed to the walls of the shaft 18 at the bottom of the side wall 10 or to the guide plates affixed there, while being affixed above to a plate 54 extending as far the sidewall 10 and connecting with the support angles 52, said plate 54 preventing overflow of mixed waters through the seal and the retention gate. The retention gate 20 is made of plate and reinforced by ribs 64 welded at mutual lateral spacings to the back side of the gate and forming fittings at upper extensions to affix the pivot shaft 22. The support beams 38 for the counterweight 42 are shown in FIG. 2 with a downward slant of about 10° to the horizontal for the closed position of the retention gate.

As shown by the rear view of the retention gate 20 shown in FIG. 6, the pivot shaft 22 is composed of individual bolts 68 held in the particular fittings 53 of the support angles 52 to which are affixed associated ribs 64 and support beams 38. The counterweight 42 is suspended by several linkbars 50 to the support beams 38 and it consists of individual weights 42*a* which can be changed.

The modified retention gate 20 of FIG. 7 is fitted with a continuous pivot shaft 22 extending through clearances in the ribs 64 to which it is rigidly affixed. A continuous counterweight 42 is mounted to linkbars 50 between two support beams 38 mounted on the pivot shaft 22, said counterweight 42 where called for being a buoyancy-adjustable float when the retention gate is designed as a backflow protective means (FIG. 5).

Besides the selecting means for length and direction of the support beams 38 and the sizes of the counterweights, additional adjusting means varying the distance of the counterweight from the pivot shaft 22 are available to control the closing force and to alter such force as necessary along the gate's pivoting path. According to FIG. 8, a slide block or transverse bolt 56 is mounted at the upper end of the linkbar 50 of the counterweight 42 and is displaceable in an elongated slot 58 at the end of the support beam 38. The bolt 56 automatically slides by gravity in the elongated slot 58 and slopes in such a way relative to a radial line starting from the pivot shaft and running in the direction of the support beam that its lower end will be most distant from the pivot shaft 22 when the support beam 38 assumes the position shown in solid lines (retention gate closed) and will be nearest the pivot shaft 22 when the support beam 38 is in the dashed-line position (open retention gate). The elongated slot may be arcuate in order to still better match the varying force of closure to the regulation characteristics of the retention gate 20.

As shown in FIG. 9, a similar adjustment apparatus comprises a parallel elongated slot 58 in the support beam 38, the bolt 56 being prestressed radially outward by a spring 60 within said slot. Because, in the closed position, the support beam 38 and the elongated slot are approximately horizontal, the spring 60 pulls the bolt 56 outward, the more easily that in this position the counterweight 42 hardly affects the spring action. The more the retention gate 20 is opening, the farther the support beam 38 pivots upward, and the more the counterweight 42 pulls the bolt 56 radially toward the inward end of the elongated slot 58, whereby the torque exerted by the counterweight 42 decreases continuously.

A change in closing force depending on the pivot angle of the retention gate also may be implemented as shown by FIG. 10 using a cable 50*a* running over a stationary deflecting roller 70 and linking the counterweight 42 and the support beam 38. The different directions of the support beam 38 and of the cable 50*a* acting on it that are related to the open and closed positions of the retention gate 20 show that the closing torque exerted by the counterweight on the pivot shaft 22 continuously decreases from the closed position to the open position of the retention gate.

We claim:

1. A retention gate unit for controlling water overflow from a storage area to a discharge area in a sewage processing plant, comprising:

a) a basin for storing water, said basin including a vertical wall;

b) said vertical wall including an overflow opening for fluid communicating said basin with a discharge area;

c) a flow gate operably associated with said overflow opening and positioned downstream thereof;

d) said gate is pivotably mounted at an upper section thereof by a stationary horizontal axis positioned downstream of said overflow opening and providing pivoting movement of said gate between an open position and a closed position;

e) said gate extending at an angle away from said overflow opening when in said closed position whereby a bottom edge thereof abuts against said vertical wall at a point beneath said overflow opening;

f) said bottom edge of said gate is disposed off of said vertical wall when in said open position to provide a relief opening having a substantially horizontal cross-section;

g) a counterweight operably connected to and positioned downstream of said gate for urging said gate into said closed position;

h) a stationary frame member disposed about said overflow opening and extending away therefrom and cooperating with said gate;

i) said frame member including a peripheral seal;

j) said gate including side flanges with free upper and lower generally coplanar front edges; and k) said front edges cooperate with said peripheral seal in said closed position of said gate.

2. The retention gate unit of claim 1, wherein:

a) said gate in said closed position thereof extends at an angle of about 20° to about 60° with respect to a vertical intersecting said point of abutment at said vertical wall, such that said upper section is positioned away from said opening and said lower section is adjacent thereto.

3. The retention gate unit of claim 1, wherein:

a) said gate is generally planar in configuration.

4. The retention gate unit of claim 1, wherein:

a) said gate is generally arcuate in configuration and having a generally convex section extending away from said opening.

5. The retention gate unit of claim 1, and including:

a) an elongated support member operably connected to said gate and pivotable about said horizontal axis for supporting said counterweight;

b) said support member extending at an angle of about −10° to about +25° to a horizontal plane.

6. The retention gate unit of claim 1, wherein:

a) said overflow opening includes top and bottom sections;

b) a predetermined level for maintaining water extends between said top and bottom sections; and c) said horizontal axis being located at about ⅔ the height between said bottom section and said level.

7. The retention gate unit of claim 1, and including:

a) a float operably connected to said counterweight.

8. The retention gate unit of claim 7, wherein:

a) said counterweight comprises said float.

9. The retention gate unit of claim 5, wherein:

a) said support member includes an elongated slot extending substantially radial with respect to said horizontal axis;

b) said counterweight is supported by a suspension member, one end of which is slidable within said slot.

10. The retention gate unit of claim 9, wherein:

a) said one end of said suspension member within said slot is spring-biased towards said slot end remote from said horizontal axis.

11. The retention gate unit of claim 5, wherein:

a) said counterweight is supported by a cable connected to said support member, and by a deflecting roller frictionally engaging said cable and stationarily mounted beneath said support member.

12. A retention gate unit for controlling water overflow from a storage area to a discharge area in a sewage processing plant, comprising:

a) a basin for storing water, said basin including a vertical wall;

b) said vertical wall including an overflow opening for fluid communicating said basin with a discharge areas;

c) a flow gate operably associated with said overflow opening and positioned downstream thereof;

d) said gate is pivotably mounted at an upper section thereof by a stationary horizontal axis positioned downstream of said overflow opening and providing pivoting movement of said gate between an open position and a closed position;

e) said pate extending at an angle away from said overflow opening when in said closed position whereby a bottom edge thereof abuts against said vertical wall at a point beneath said overflow opening;

f) said bottom edge of said gate is disposed off of said vertical wall when in said open position to provide a relief opening having a substantially horizontal cross-section;

g) a counterweight operably connected to and positioned downstream of said gate for urging said gate into said closed position, and;

h) said gate having an arcuate configuration at a rear side thereof and reinforced by laterally spaced vertically extending reinforcement ribs rigidly fixed at upper sections thereof to a horizontal pivot shaft including said horizontal axis.

13. The retention gate of claim 12 and wherein:

a) said upper section including a top edge adapted to abut against an apron member extending above said stationary horizontal axis when said gate is in a closed position whereby a seal is provided against fluid flow between said basin and said discharge area.

* * * * *